US006161356A

United States Patent [19]

Richardson

[11] Patent Number: 6,161,356

[45] Date of Patent: Dec. 19, 2000

[54] BUILDING ELEMENTS

[75] Inventor: Christopher Richardson, Clitheroe, United Kingdom

[73] Assignee: Ultraframe (UK) Limited, Clitheroe, United Kingdom

[21] Appl. No.: 09/203,017

[22] Filed: Dec. 1, 1998

[30] Foreign Application Priority Data

Nov. 27, 1998 [GB] United Kingdom ..... 9826004

[51] Int. Cl.[7] ..... E04D 3/32; E04D 3/35

[52] U.S. Cl. ..... 52/586.2; 52/220.3; 52/461; 52/469

[58] Field of Search ..... 52/586.1, 586.2, 52/582.1, 220.2, 220.3, 270, 459, 461, 465, 469

[56] References Cited

FOREIGN PATENT DOCUMENTS

| | | | |
|---|---|---|---|
| 0070930 A1 | 2/1983 | European Pat. Off. . | |
| 1244155 | 8/1971 | United Kingdom | 52/586.1 |
| 1272729 | 5/1972 | United Kingdom | 52/586.1 |
| 1511089 | 5/1978 | United Kingdom . | |
| 1528874 | 10/1978 | United Kingdom . | |
| 2147334 | 5/1985 | United Kingdom . | |
| 2243170 | 10/1991 | United Kingdom | 52/582.1 |
| 2268765 | 1/1994 | United Kingdom . | |

*Primary Examiner*—Michael Safavi
*Attorney, Agent, or Firm*—Rockey, Milnamow & Katz, Ltd.

[57] ABSTRACT

A building structure, as for a conservatory roof, in which hollow building panels of a plastic material are connected side-by-side by upper and lower coupling members, between adjacent building panels. The coupling members receive aluminum reinforcing beams having longitudinal slots, in which the lower coupling members are held together. Each building panel has an integral cap, which covers the upper coupling members of two adjacent building panels for holding the adjacent building panels together while such a reinforcing beam is slid therebetween.

9 Claims, 1 Drawing Sheet

BUILDING ELEMENTS

Figure 1:
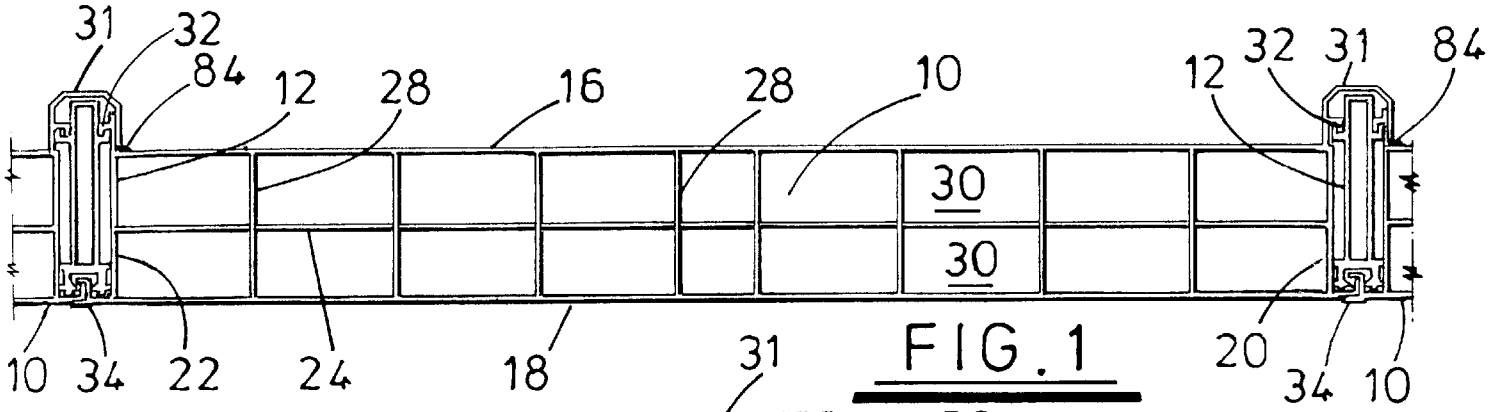

This invention concerns building elements for making structures and structures made from such building elements.

Self-supporting roofs or roof sections are known which comprise a plurality of extruded plastics profile; elements connected side-by-side, each element having at least one longitudinal chamber or duct and coupling members, by which neighbouring profile elements are interconnected, the adjacent coupling members of neighbouring profile elements engaging to form a duct.

In GB 1528874, the coupling of adjacent panels form together a duct through which is inserted a longitudinally elongate locking member, the locking member having at least two opposite longitudinal edges that are a sliding fit within the duct, so as to prevent the locking member from twisting under load.

In GB 1511189, it was further proposed that the longitudinal chamber of each element have an internal partition substantially parallel to the outer surfaces of a building structure made up of the elements. The partition was principally to provide additional heat insulation.

Further proposals for such profile elements have been made in EP-A-070930, in which multiple duct elements have main ducts and intermediate secondary ducts having internal partitions that are in line. Connection of these elements together is as disclosed in GB 1511189 and GB 1528874.

A yet further proposal for such elements was made in GB 2147334A, in which upper coupling members, consist of cylindrical, slotted downwardly open flanges of such dimension that a flange of a first element can be snap locked to a flange of a second identical element. In addition, the lower end of one side wall of an element is integrally connected to a guide member which is adapted to engage the anchoring member of an adjacent element so as to maintain the lower ends of two adjacent side walls in spaced relationship so as to form a tight connection between such elements.

In our own Patent Application No. GB 2268765A, we propose a hollow building element of plastics material comprising a plurality of hollow ducts in two layers and having, at opposite sides thereof coupling members, whereby elements may be connected to each other, upper coupling members comprising a part engageable with a stiffening or reinforcing beam.

A problem with 411 of the above-described building elements lies in the speed of installation.

An object of this invention is to provide building elements for making building structures, which may be speedier to erect.

According to a first aspect of this invention there is provided a hollow building element of plastics material comprising one or more longitudinal ducts and having, at opposite sides thereof coupling members whereby elements may be connected to each other directly or indirectly, wherein at one side of each element an integral cap is provided for said connection of adjacent elements.

According to a second aspect of this invention there is provided a building structure comprising hollow building elements of plastics material coupled together side by side, the elements comprising one or more longitudinal ducts and having at opposite sides thereof coupling members whereby the elements are coupled together directly or indirectly, wherein at one side of each element an integral cap is provided which covers said connection of adjacent elements.

Preferred building elements of the invention may have a single longitudinal duct, a single layer of adjacent longitudinal ducts, a pair of longitudinal ducts one on top of the other, or a plurality of longitudinal ducts in two or more layers, especially two layers.

Each building element preferably has a different lower coupling member at each end and the two types of lower coupling member are preferably complementary so as to fit together when panels are coupled side by side.

Preferably lower coupling members are arranged to be held together by means of a reinforcing beam between adjacent elements. Preferably one lower coupling member comprises a horizontal channel in which the end of another coupling member sits, each member having a part extending upwardly which parts are prevented from separating by more than a desired distance by means of the reinforcing beam. The preferred reinforcing beam has a longitudinal slot in its base in which the said upwardly extending parts of the lower coupling members locate.

The building elements of the invention preferably also have upper coupling members. Preferred such members interengage with formations of the reinforcing beam. A preferred upper coupling member comprises a flange forming a channel section which is engageable in a complementary channel section of the reinforcing beam.

The reinforcing beam preferably has ribs or the like on its outer surface particularly in its lower regions in order to limit areas of contact between the beam and the building elements in the space between adjacent elements.

The reinforcing beam is preferably a hollow beam, especially comprising a rectangular box section.

The integral cap at one side of each element is preferably generally an inverted U-shape in section and optionally has on its free edge a formation for receiving gasket material, such as of rubber or other elastomeric material or has coextruded therealong gasket material, such as of rubber or other elastomeric material, the gasket material being for sealing between the cap and a top surface of the adjacent building element.

The provision of an integral cap has advantages over the provision of a separate cap as is customary for prior art building structures made from plastics elements. Sealing of the connection between adjacent elements is improved as there is only a seal along one side of the connection rather than on both sides. The integral cap helps to hold panels together as they are being installed which may facilitate speedier erection of a building structure from such elements. Furthermore, the reinforcing beams for use in forming a building structure of the invention may be simpler in form than prior art reinforcing beams as no provision has to be made for retaining, for example, a snap-on. cap.

The building elements of the invention will usually be made of plastics material, such as polyvinyl chloride or preferably polycarbonate. The building elements of the invention may be transparent or translucent and may be clear or tinted. Such elements are especially suitable for forming conservatory roofs. Alternatively, the building elements may be opaque and may be white or coloured. Such elements may be used for structures, such as, for example sun rooms or solariums.

Figure 2:
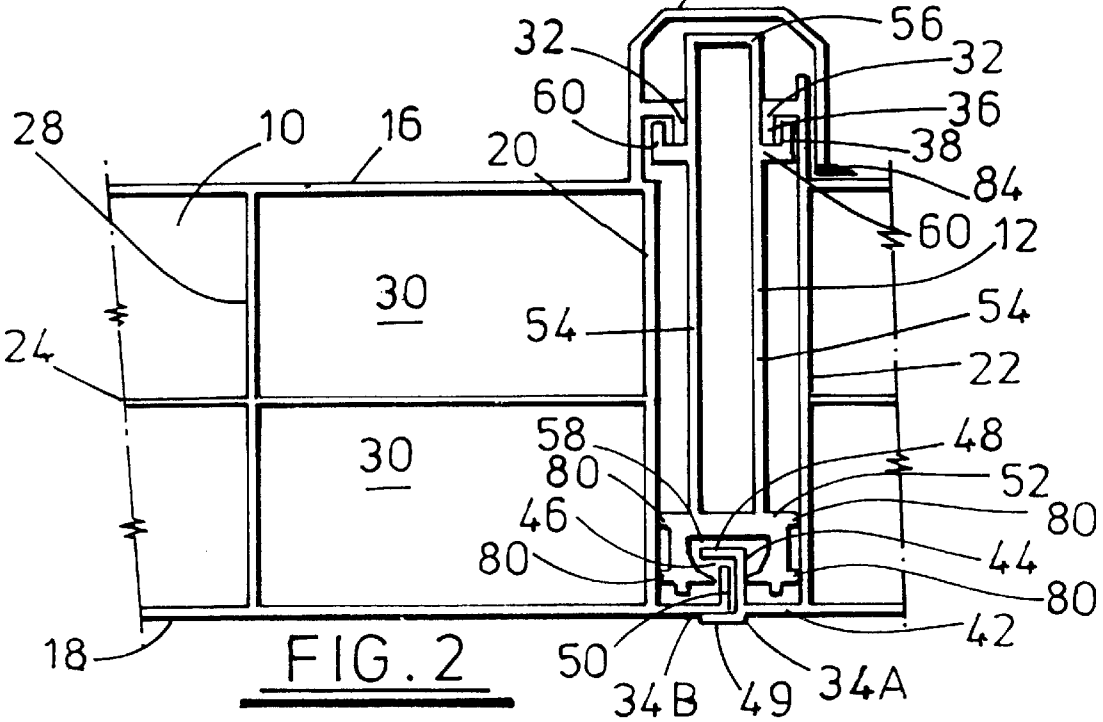

This invention will now be further described, by way of example only, with reference to the accompanying drawing, in which:

FIG. 1 shows part of a building structure made up of building elements of the invention; and FIG. 2 is an enlarged view of the connection between adjacent building elements.

Referring to the accompanying drawing, a building structure, such as a conservatory roof, comprises building panels 10 of plastics material, such as polycarbonate, connected together side by side to and by means of aluminium reinforcing beams 12.

The building panels 10 are hollow and have flat top and bottom walls 16, 18 respectively, end walls 20, 22, an intermediate wall 24 parallel to the top and bottom walls and intermediate walls 28 parallel to the end walls, thereby forming ducts 30 through the panels in two rows on top of each other. The intermediate walls 24 and 28 are generally thinner the outer walls of the panels. The end walls 20, 22 extend above the top wall 16 and in the case of end wall 20 the extension forms a cap 31 for the connection between adjacent panels.

At each end of the panels are upper and lower coupling members 32, 34 respectively. The upper coupling members are the same at each end of the panels, whereas the lower coupling members 34A at one end of the panels are different to the coupling members 34B at the opposite ends of the panels.

The upper coupling members 32 each comprise an inverted L-shaped flange 36 forming, with the end wall of the panel, a downwardly open channel 38.

The lower coupling member 34A comprises a flange 42 extending from the end wall of the panel and terminating with a square C-section part 44 forming a horizontal channel 46 with a top wall 48 and a bottom wall 49. The lower coupling member 34B comprises a flange 50 extending from the opposite end wall of a panel top the coupling member 34A. The flanges 42 and 50 may be ducted.

The reinforcing beam 12 is formed as a hollow extrusion of generally rectangular section and has a base 52, sides 54 and a top 56. The base 52 is formed with a channel 58 therealong with rebated sides in order to accommodate top wall 48 of a coupling member 34A.

Sides 54 of the beam have L-shaped projections 60 forming a pair of upwardly open channels. The channels 60 accommodate the flange parts 36 of the upper coupling members 32. The beam base 52 has ribs 80 therealong in order to reduce the areas of contact between the beam and the panels, thereby reducing likelihood of heat loss through a panel connection.

The cap 31 on end wall 20 of a panel 10 is generally an inverted U-shape in section and has along its free edge opposite the end wall 20 coextruded gasket material 84 of rubber or other suitable elastomeric material for sealing against the top wall of the adjacent panel.

To construct a roof using building panels 10, the panels are laid side-by-side on a structure providing support at opposite ends of the panels with the lower coupling members 34A and B engaged and the cap 31 of one panel overlying the extension of end wall 22 of the adjacent panel to hold them together, whilst a beam 12 is slid into the space between the panels to hold the lower coupling members together and to engage the upper coupling members.

Whilst the invention has been specifically described in relation to a conservatory roof, it will be appreciated that the panels may be used for forming building structures for other purposes.

What is claimed is:

1. A building structure comprising at least two adjacent hollow building elements connected side-by-side, the hollow building elements comprising a plurality of longitudinal ducts and upper and lower coupling members at opposite sides of each said building element, and a reinforcing beam slidable between so as to be thus connected to said two adjacent building elements, in a coupling area between said two adjacent building elements, the reinforcing beam being a hollow beam and having a base formed with a longitudinal slot, the lower coupling elements being different at opposite sides of each building element of said two adjacent building elements and being complementary to fit together, the lower coupling members being held together in the slot of the reinforcing beam, and each said building element having at one side an integral cap that extends over the coupling area between said same building element and an adjacent said building element, the integral cap constituting means for holding said same building element and the adjacent said building element together while the longitudinal beam slidable therebetween is slid therebetween.

2. The building structure of claim 1, wherein one lower coupling member of the building elements comprise a horizontal channel in which the end of another coupling members sits, each member having a part extending upwardly which parts arm prevented from separating by more than a desired distance by means of the reinforcing beam.

3. The building structure of claim 1, wherein the building elements have upper coupling members.

4. The building structure of claim 3, wherein the upper coupling members interengage with formations of the reinforcing beam.

5. The building structure of claim 4, wherein the upper coupling members comprise flange forming channel sections which are engaging in complementary channel sections of the reinforcing beam.

6. The building structure of claim 1, wherein the reinforcing beam has ribs on its outer surface in order to limit areas of contact between the beam and the building elements in the space between adjacent elements.

7. The building structure of claim 1, wherein the integral cap at one side of each element is generally an inverted U-shape in section.

8. The building structure of claim 1, wherein the cap has a free edge on which is coextruded gasket material.

9. A building structure as claimed in claim 1, wherein the building elements are made of a plastics material selected from the group consisting of polyvinyl chloride and polycarbonate.

* * * * *